United States Patent [19]

Kume

[11] Patent Number: 4,809,583

[45] Date of Patent: Mar. 7, 1989

[54] DEVICE FOR ADJUSTING REED OF CLARINET OR THE LIKE

[75] Inventor: Tadashi Kume, Hamamatsu, Japan

[73] Assignee: G. LeBlanc Corporation, Kenosha, Wis.

[21] Appl. No.: 141,053

[22] Filed: Jan. 5, 1988

[30] Foreign Application Priority Data

Feb. 24, 1987 [JP] Japan ..... 62-02618[U]

[51] Int. Cl.[4] ..... G10G 7/00

[52] U.S. Cl. ..... 84/453; 84/383 A

[58] Field of Search ..... 84/453, 458, 383 A

[56] References Cited

U.S. PATENT DOCUMENTS

| | | | |
|---|---|---|---|
| 555,962 | 3/1896 | Meister | 84/458 X |
| 2,070,218 | 2/1937 | Stirn | 84/453 |
| 3,389,630 | 6/1968 | Browder | 84/458 |
| 4,231,404 | 11/1980 | Van Doren et al. | 84/458 X |

*Primary Examiner*—L. T. Hix

*Assistant Examiner*—Brian W. Brown

*Attorney, Agent, or Firm*—Trexler, Bushnell, Giangiorgi & Blackstone, Ltd.

[57] ABSTRACT

A device for adjusting a reed for a clarinet, or the like, said device having a reed guide base and an adjusting spatula having a curved end portion with a file bonded thereto for adjusting the thickness of the reed.

4 Claims, 1 Drawing Sheet

DEVICE FOR ADJUSTING REED OF CLARINET OR THE LIKE

BACKGROUND OF THE INVENTION

This invention relates to a device for adjusting a reed of a wood wind-instrument such as a clarinet or a saxophone.

A reed is generally prepared from a stalk of the natural material of a reed. This is because materials which are excellent in acoustic and vibrative properties have not been found yet except in reeds.

About a half of a reed is formed into a taper which becomes gradually thin towards its tip. It is the tapered portion that has a great influence on the vibration characteristics of the reed. Since reeds are mechanically processed to have a regular predetermined shape, all of them should provide a similar common vibration property. However, in practice, it is said that only about 10 percent of them can be used as mechanically processed for ordinary play.

Accordingly, it is an object of the present invention to provide a reed adjusting device which is capable of adjusting reeds, which do not fit to actual use, to a usable state and which is conveniently used for readjustment of reeds in the case where they do not work due to the deterioration of their vibrating properties.

SUMMARY OF THE INVENTION

The constructional feature of the present invention resides in a device for adjusting a reed of a clarinet or the like instrument which comprises a reed guide base including a transparent flat plate whose lengthwise end portion is provided at the three sides with guide walls, and an adjusting spatula having a front end portion formed into a curved spatula to which a file is bonded and a rear end portion bent to form a bent portion. The adjusting device is assembled such that the fore end curved spatula portion of the adjusting spatula is inserted within the side guide walls with the reed being placed on the reed guide base, with the simultaneous positioning of the rear end bent portion at the back side of the flat plate of the reed guide base.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following descriptions taken in connection with the accompanying drawings in the several figures of which like reference numerals identify like elements, and in which:

DETAILED DESCRIPTION OF A PREFERRED EMBODIMENT

Figure 1:
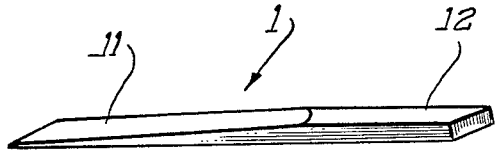
FIG. 1 is a perspective view showing a reed of a clarinet or saxophone.
Figure 2:
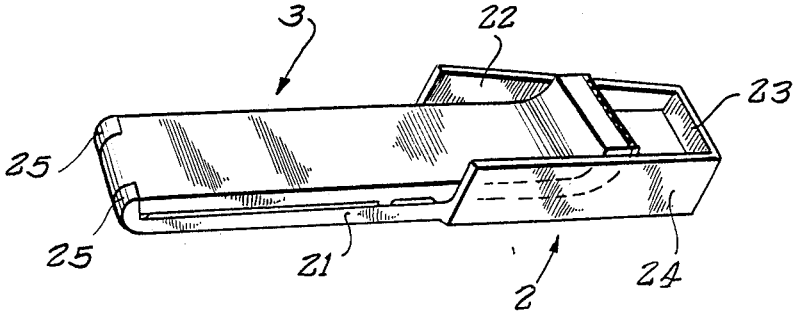
FIG. 2 is a perspective view showing an assembled state of one embodiment of the reed adjusting device of this invention.

Turning now to the drawing wherein like components are designated by like reference numerals throughout the various figures, the details of the present invention will be described with respect to one embodiment with reference to the drawings.

As shown in FIG. 1, reed 1 prepared from stalks of a natural material such as a reed has a thin, rectangular shape and is composed of two portions, i.e. a tapered portion 11 which is tapered towards its one end and a flat thick portion 12.

A reed guide base 2 has, as its base, a transparent, flat plate 21 which is thin and rectangular in shape and is formed of an acryl resin or the like. The plate is slightly larger than the reed so as to be able to place the reed thereon. The plate has its one lengthwise end provided at its three sides with guide side walls 22, 23 and 24.

Since the guide side walls are provided to accommodate and fix the flat portion 12 of the reed, the height of the walls is slightly greater than the thickness of the reed. The other end of the plate 21 is provided with guide projections 25 and 25. The plate 21 is also provided with an engaging projection 26 at the side opposite to the surface on which the reed is placed.

Adjusting spatula 3 is also formed of a thin plate which is rectangular (tape-like form) in shape and which has nearly the same width as the reed guide base 2. One end of the spatula 3 is gently curved to form a curved spatula portion 31, while the other end of the spatula forms a bent portion 32.

The curved portion 31 is provided with a file 4 such as sand-paper or scouring brush by means of a both-sides adhesive. A stopper projection 33 is provided inside of the bent portion 32.

Figure 3:
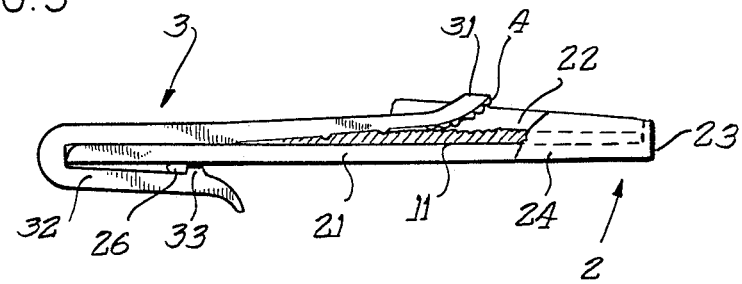
FIG. 3 is an elevational view cut away in part showing an assembled state of the above embodiment of the reed adjusting device.

The thus constructed adjusting spatula 3 is normally assembled on the reed guide base in a manner as shown in FIG. 3.

That is, the reed 1 is placed on the flat plate 21 of the reed guide base 2 such that the flat portion 12 of the reed 1 is accommodated in the space defined by the guide side walls 22, 23 and 24. Then the adjusting spatula 3 is inserted along the lengthwise direction over the reed so that the curved portion 31 is accommodated in the space between the guide side walls 22, 23 and 24 and that the bent portion 32 is positioned on the backside (on the side opposite to the surface on which the reed is positioned) of the flat plate 21 of the reed guide base 2.

In this case, the bent portion 32 is fitted between the guide projections 25 and 25 so as to prevent the lateral movement of the adjusting spatula 3. Also, the stopper projection 33 of the adjusting spatula 3 gets over and engages with the engaging projection 26 of the reed guide base 2 so that the disengagement of the adjusting spatula 3 from the base 2 is prevented.

Figure 4:
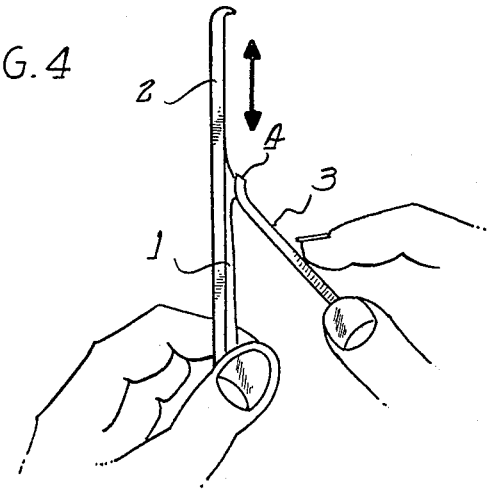
FIG. 4 is an explanatory view showing the operating state of the reed adjusting device of this embodiment.

In the case of adjusting the reed with the thus constructed adjusting device, the reed guide base 2 is held by one hand, as shown in FIG. 4, with the adjusting spatula 3 being held by the other hand. The file 4 bonded to the curved spatula portion is applied on the tapered portion 12 of the reed 1 placed on the flat plate 21 of the reed guide base and is reciprocally moved as shown by the arrow to abrade the tapered portion 12 of the reed 1 with the file. Thus, the thickness is gradually reduced and adjusted at will.

Hitherto, no simple tools for adjusting reeds have been available. Therefore, such adjustment has been entrusted to specialists. According to the reed adjusting device of the present invention, the adjustment of reeds can be easily made at that place by amateurs without any skill. Therefore, the device is very convenient in adjusting inferior reeds before use and re-adjusing reeds during use.

The reed adjusting device of this invention has a size approximately equal to the reed and is compact and light in weight. Therefore, transportation and storage of the device is very easy. This is convenient because of the continuous carriage of a spare reed.

Further, the present invention has an advantage because the transparency of the reed guide base makes it possible to precisely and easily adjust the reed by watching it with eyes.

The invention is claimed as follows:

1. A device for adjusting a reed of a clarinet or the like, characterized in that the device comprises a reed guide base including a thin rectangular flat plate, and an adjusting spatula having an end portion formed into a curved spatula to which a file is bonded and that the device is so arranged as to adjust the thickness of the reed placed on said reed guide base by pressing the reed with the file bonded to the curved spatula at the end of said adjusting spatula.

2. A device of claim 1 wherein said reed guide base includes a flat plate having guide walls.

3. A device of claim 1 wherein said adjusting spatula includes a bent portion having a stop projection.

4. A device of claim 3 wherein said reed guide base includes an engaging projection for engaging said stopper projecting on said spatula.

* * * * *